United States Patent [19]

Ciambra

[11] 4,249,393

[45] Feb. 10, 1981

[54] EARRING OR SIMILAR ARTICLE

[76] Inventor: Frank P. Ciambra, 772 Stewart St., Ridgefield, N.J. 07657

[21] Appl. No.: 87,314

[22] Filed: Oct. 22, 1979

[51] Int. Cl.[3] ..... A44C 7/00

[52] U.S. Cl. ..... 63/12

[58] Field of Search ..... 63/12, 13

[56] References Cited

U.S. PATENT DOCUMENTS

| | | | |
|---|---|---|---|
| 217,092 | 7/1879 | Greene | 63/12 |
| 799,056 | 9/1905 | Huber | 63/12 |
| 3,260,068 | 7/1966 | Micaleff | 63/12 |

FOREIGN PATENT DOCUMENTS

| | | | |
|---|---|---|---|
| 28097 | 4/1907 | Austria | 63/12 |
| 3031 | of 1881 | United Kingdom | 63/12 |

*Primary Examiner*—F. Barry Shay

*Attorney, Agent, or Firm*—Charles E. Temko

[57] ABSTRACT

An earring for use with pierced earlobes including an ornament having a base. An elongated relatively rigid wire extends from a rear surface of said base, through the earlobe of the user, and curves under and in front of the lobe to obtain a very light and comfortable purchase, sufficient to prevent accidental loss.

3 Claims, 6 Drawing Figures

EARRING OR SIMILAR ARTICLE

BACKGROUND OF THE INVENTION

This invention relates generally to the field of ornamental jewelry, and more particularly to an improved form of earring which is substantially easier to engage with the earlobe of a wearer, and considerably more comfortable to wear.

Most prior art earrings may be classified among a relatively few number of types. Those wearers not having pierced earlobes normally use earrings having a U-shaped earring wire, a free end of which is threaded and accommodates a set screw. Upon installation, the set screw is tightened, and when the engagement is sufficiently secure, the necessary pressure exerted by the set screw causes discomfort even after a relatively short period of time. An alternate construction for these wearers employs spring tension in lieu of a set screw, with substantially the same degree of resultant discomfort.

Users having pierced earlobes are somewhat more fortunate. In one form of earring wire, a threaded hollow sleeve is engaged by a correspondingly threaded screw having an enlarged head. When fully seated, it does not crush the earlobe. However, the engagement of the screw, sight unseen, is not always easily accomplished. This is equally true of an alternate construction which employs a notched shank and a resilient nut which slidably engages the shank and the notch.

In each of the above constructions, either considerable manipulation is necessary for installation, and in some cases removal as well. In other cases, a secure engagement with the earlobe cannot be obtained without discomfort.

SUMMARY OF THE INVENTION

Briefly stated, the invention contemplates the provision of an improved earring in which the above described disadvantages have been substantially eliminated. The earring ornament, either integral or mounted in a socket, is provided on a rearward or inner surface thereof with a curved relatively rigid wire which passes from the outer surface of the earlobe through the pierced area and curves downwardly and across the outer surface of the earlobe to terminate in an area adjacent the ornament. The area enclosed by the loop accommodates the lower portion of the earlobe, and contact with a lower peripheral edge of the lobe, together with the contact with the pierced portion of the lobe, provides a gentle purchase on the lobe, preventing accidental loosening and loss.

BRIEF DESCRIPTION OF THE DRAWING

In the drawing, to which reference will be made in the specification, similar reference characters have been employed to designate corresponding parts throughout the several views.

DETAILED DESCRIPTION OF THE DISCLOSED EMBODIMENTS

Figure 1:
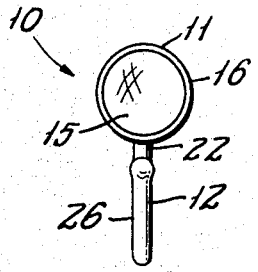
FIG. 1 is a front elevational view of a first embodiment of the invention.
Figure 2:
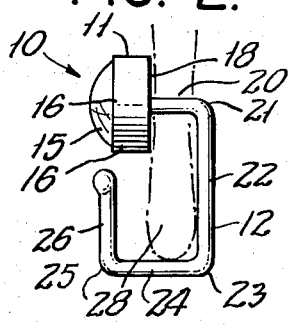
FIG. 2 is a side elevational view thereof.
Figure 3:
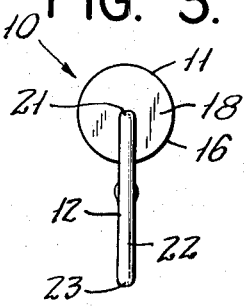
FIG. 3 is a rear elevational view thereof.
Figure 4:
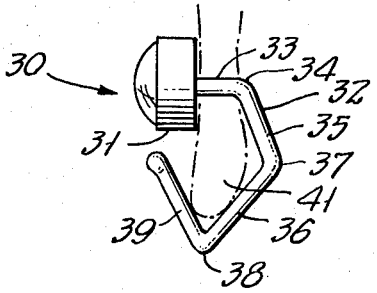
FIG. 4 is a side elevational view showing a second embodiment of the invention.

In accordance with the first embodiment of the invention, illustrated in FIGS. 1 to 3, inclusive, and generally indicated by reference character 10, the device comprises broadly an ornament member 11 and a wire back member 12.

The ornament member 11 may be of any desired configuration, as for example, that illustrated in the drawing which includes a jewel 15 mounted in a cylindrical metallic socket 16. If desired, it may be in the form of an integral metallic or plastic casting, which, in any event, defines a planar rear surface 18.

The wire back member 12 is soldered or otherwise attached to the rear surface 18, and includes a rearwardly extending segment 20, a bent portion 21, a downwardly extending segment 22, a second bent portion 23, an outwardly extending segment 24, a bent portion 25, and an upwardly extending segment 26 terminating in a slightly enlarged end 27. The member 12 surrounds an enclosed area 28 in which the lower portion of an earlobe 29 is positioned. It will be observed that the enclosed area is slightly greater than the cross-section of the engaged portion of the lobe, so that the purchase obtained thereon is confined principally to the bore in the earlobe, and the lower peripheral edge, whereby pinching is avoided. No compressive force is required, and the earlobe, itself, having a degree of resilience, provides the necessary purchase to prevent accidental dislodgement.

The second embodiment of the invention, generally indicated by reference character 30, differs from the first embodiment in the shape of the back member. The ornament member 31 is substantially identical, and the back member 32 includes a rearwardly extending segment 33, a first bent portion 34, first and second downwardly extending members 35 and 36, respectively, interconnected by a bent portion 37, an acutely bent portion 38 and an upwardly extending member 39 terminating in an enlargement 40. The enclosed area 41 is somewhat rhombic in shape, and because of the converging members 36 and 39, a slightly greater degree of purchase on the earlobe is obtained.

Figure 5:
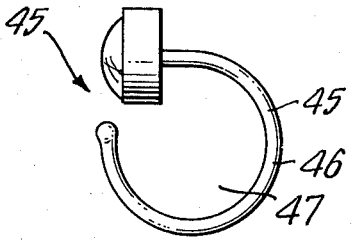
FIG. 5 is a side elevational view showing a third embodiment of the invention.
Figure 6:
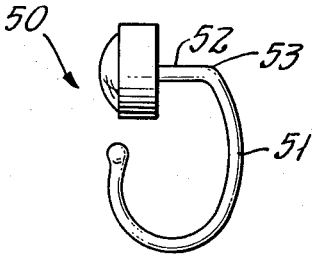
FIG. 6 is a side elevational view showing a fourth embodiment thereof.

The third embodiment, illustrated in FIG. 5, and generally indicated by reference character 45, is particularly suitable for use by those wearers having relatively short thick lobes. The wire back 46 defines a circular enclosed area 47 for this purpose. It is somewhat more easily shaped than is the case in the first and second embodiments.

The fourth embodiment combines the features of the second and third embodiments. In this embodiment, generally indicated by reference character 50, the wire back member 51 is of ovoid shape, including a single rearwardly extending segment 52, and a single bent portion 53.

During installation, in the case of each embodiment, the free terminal of the wire back member is inserted from the outer surface of the earlobe, and manually moved to a point where the planar rear surface of the ornament member overlies the outer surface of the earlobe. This will position the lower portion of the earlobe within the enclosed area to achieve the above described purchase, following which the earrings may be worn for extensive periods without discomfort. They are as readily removed by gently grasping the ornament member and moving the wire outwardly through the bore in the earlobe until complete disengagement has been effected.

It will be observed that there are no moving parts involved in the manufacture of my invention, in which the cost of fabrication may be of a very low order, considerably less than that of conventional earring findings. The installation of any of the embodiments involves practically no distortion of the device itself, the flexibility of the earlobe permitting most of the necessary manipulation without difficulty.

I wish it to be understood that I do not consider the invention limited to the precise details of structure shown and set forth in this specification, for obvious modifications will occur to those skilled in the art to which the invention pertains.

I claim:

1. An improved earring for use with pierced ear lobes comprising: an ornament member having a generally planar rear surface; a unitary relatively stiff earring wire having a first end fixed to and extending substantially perpendicular to said planar rear surface, said first end leading to an open loop portion defining an enclosed area and terminating at a second end at a point forwardly of said rear surface, and in the area of said ornament member; whereby said enclosed area is of an effective width substantially greater than the width of an ear lobe and is of a size to accommodate the lower portion of the ear lobe so that contact with a lower peripheral edge of the lobe together with contact with the pierced portion of the lobe will provide a gentle purchase on the lobe in the absence of any compressive forces against the sides of the ear lobe.

2. An earring in accordance with claim 1, in which said wire is in generally angular configuration, including a plurality of rectilinear segments joined by bent portions.

3. An earring in accordance with claim 1, in which said wire is in generally curvilinear configuration.

* * * * *